US006571667B2

(12) United States Patent
Price et al.

(10) Patent No.: US 6,571,667 B2
(45) Date of Patent: Jun. 3, 2003

(54) MANUAL TONG SAFETY LATCH

(75) Inventors: Herman Paul Price, Houston, TX (US); Richard Harland Miller, Gainesville, TX (US); William Harold Macon, Blackwell, TX (US)

(73) Assignee: National-Oilwell, L.P., Houston, TX (US)

( * ) Notice: Subject to any disclaimer, the term of this patent is extended or adjusted under 35 U.S.C. 154(b) by 0 days.

(21) Appl. No.: 09/731,285

(22) Filed: Dec. 6, 2000

(65) Prior Publication Data

US 2002/0066339 A1 Jun. 6, 2002

(51) Int. Cl.[7] ..... B25B 13/50
(52) U.S. Cl. ..... 81/57.33; 81/57.15; 81/90.5
(58) Field of Search ..... 81/90.3, 90.4, 81/90.5, 90.6, 90.7, 57.15, 57.33

(56) References Cited

U.S. PATENT DOCUMENTS

| | | | | |
|---|---|---|---|---|
| 1,125,554 A | | 1/1915 | Keck | |
| 1,675,748 A | | 7/1928 | Bunker | |
| 1,763,135 A | | 6/1930 | Cox | |
| 1,925,970 A | | 9/1933 | Pennington | |
| 4,095,493 A | * | 6/1978 | Hayes | 81/57.33 X |
| 4,167,128 A | | 9/1979 | Chandler et al. | |
| 5,192,105 A | | 3/1993 | Walker | |
| 5,542,318 A | * | 8/1996 | Wesch | 81/57.33 |
| 6,058,811 A | * | 5/2000 | Stuart | 81/57.33 X |
| 6,119,558 A | * | 9/2000 | Foley | 81/90.5 |
| 6,279,426 B1 | * | 8/2001 | Neves | 81/57.33 X |

* cited by examiner

*Primary Examiner*—James G. Smith
(74) *Attorney, Agent, or Firm*—Conley Rose, P.C.

(57) ABSTRACT

A latch device for a manual tong apparatus that incorporates a secondary catch mechanism is presented. Such a secondary catch would assist in maintaining the tong assembly in it's closed position during a reversing operation or at a time when load applied to the manual tong device in the gripping direction is very low. Additionally the secondary catch would also provide some additional protection by holding the tong assembly together in the event of a failure of certain tong components. The mechanism of the secondary catch is spring loaded and operates through two secondary up-down catch arms that are deactivated by swinging a handle in the direction that corresponds to the operator's natural motion to open the lug jaw.

38 Claims, 5 Drawing Sheets

MANUAL TONG SAFETY LATCH

CROSS-REFERENCE TO RELATED APPLICATION

None.

BACKGROUND OF THE INVENTION

1. Field of the Invention

The present invention generally relates to the use of latches to hold jointed sections of manual pipe tongs as deployed in the oilfield industry together. More particularly, the invention relates to the addition of a secondary safety latch to a set of manual pipe tongs to prevent the undesired opening of the tong jaws.

2. Description of the Related Art

Manual pipe tongs are used throughout the oilfield industry to transmit torque to various tubular components of generally cylindrical shape. This assisted transmission of torque is most often used to secure, tighten (make-up), and loosen (break-out) the threaded connections of drill pipe, drill collars, casing, and tubing. Pipe tongs typically function by incorporating a cantilevered configuration that holds the workpiece in a grip that tightens as more torque is applied to the lever arm.

FIG. 1 shows a typical prior art manual tong assembly 10 as used in oilfield drilling operations to secure or rotate a generally cylindrical workpiece 12. This particular example of a manual tong assembly 10 includes a long jaw 14, a short jaw 16, a lug jaw 18, and a lever arm 20 all connected together at pivot points 22. A latch 24 is pinned to one end of the long jaw 14 and fits into a receiver step 26 at the end of the lug jaw 18.

FIGS. 2*a* and 2*b* show how different workpiece 12 sizes can be accommodated by adjusting the lengths and configurations of lug jaw 18. FIG. 2*a* shows a lug jaw 18 that includes an array of mounting locations 28 and a choice of receiver steps, 26 and 30, that may be used to adjust to various workpiece diameters (e.g. pipe diameters). Similarly, FIG. 2*b* details a hinged lug jaw 32 that is greater in length than lug jaw 18 and includes a hinged portion 34 attached to a lug portion 36 by means of a hinge 38 to allow even larger diameter workpieces to be accommodated by tong assembly 10.

Referring again to FIG. 1, jaws, 14, 16, and 18 are positioned around workpiece 12 and locked into place with latch 24. Each jaw may contain one or more sets of sharpened teeth 40 (tong dies) that are used to "bite" into workpiece 12 and prevent slippage when manual tong 10 is engaged. Once latch 24 is engaged, lever arm 20 can be rotated in direction $\alpha$ so that latch 24 is loaded in tension and tool 10 engages and applies torque to workpiece 12 in the $\alpha$ direction. Rotating lever arm 20 in direction $\omega$ will loosen jaw's 14, 16, and 18 and allow latch 24 to be released. Several handles such as 42 and 44, are typically placed about the periphery of manual tong assembly 10 to provide locations for rig workers to guide tong assembly 10 during operations.

Manual tong 10, as illustrated, is configured to only grip workpiece 12 when torque is applied on the $\alpha$ direction. Typical rig operations incorporate two sets of manual tongs, with each one being the mirror image of the other, so that one tightens in clockwise direction and the other in a counter-clockwise direction. Each can tighten or loosen the pipe threads, depending on whether it is installed in the upper position for rotating the pin (male) connection or the lower position for holding the box (female) connection. The number of tongs used in an operation and their position on the workpiece relative to each other depends on the operation being performed and the type of additional rig equipment used.

It has been found that conventional tongs sometimes allow the undesired release of latch 24 when the tong is rotated in direction $\omega$. After workpiece 12 has been positioned, it sometimes becomes necessary to slidably rotate manual tong 10 backwards (counter-clockwise as drawn, in the $\omega$ direction) about workpiece 12, in a manner similar to a ratchet, so that the engagement and rotation steps can be repeated. Latch 24 of FIG. 1 is designed to engage when the manual tong device is loaded in direction $\alpha$. If the load applied in direction $\alpha$ were slackened, or if the tong is rotated in direction $\omega$, the latch device can release undesirably, allowing tong jaws 14, 16, and 18 to rotate and swing free of workpiece 12. Because jaws, 14, 16 and 18 are typically quite massive, such undesired openings can be hazardous, as well as requiring that operations cease until they are repositioned and secured. Any improvement made in latch 24 of manual tong 10 that is able to reduce such undesired openings would increase safety and reduce downtime and the costs associated therewith.

In addition, manual tong components occasionally work themselves loose during operations, which can cause the tong apparatus to open unexpectedly and rapidly. This undesired failure has great potential to cause physical harm to operators and nearby support personnel. This potential for injury can be greatly magnified if the tong is being operated under high loads at the time of the undesired opening. For this reason, a system that maintains the jaws in a closed configuration in the event of such a failure is highly desirable.

BRIEF SUMMARY OF THE INVENTION

According to the present invention, the issues noted above are addressed by providing a latch device for a manual tong that incorporates a secondary catch mechanism. Such a secondary catch assists in maintaining the tong assembly in its closed position during a reversing operation or at a time when load applied to the manual tong device in the gripping direction is very low. Additionally the secondary catch provides protection from undesired release by holding some components of the tong assembly together in the event of a failure of certain tong components. The mechanism of the secondary catch is spring loaded and is deactivated by swinging a handle in a direction that corresponds to the operator's natural motion to open the lug jaw.

BRIEF DESCRIPTION OF THE DRAWINGS

For a detailed description of a preferred embodiment of the invention, reference will now be made to the accompanying drawings wherein.

DETAILED DESCRIPTION OF THE PREFERRED EMBODIMENTS

Figure 2A:
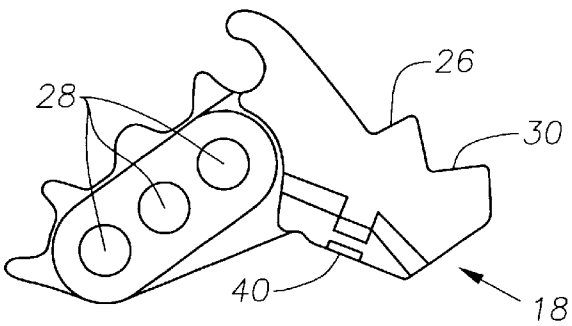
Fig. 2a (prior art)
FIG. 2*a* is a detail drawing of a lug jaw of the manual tong apparatus of FIG. 1.
Figure 2B:
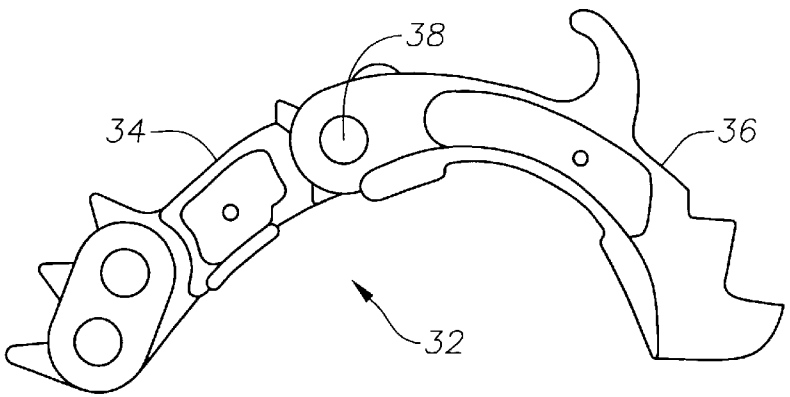
Fig. 2b (prior art)
FIG. 2*b* is an alternative to the lug jaw of FIG. 2*a;*
Figure 1:
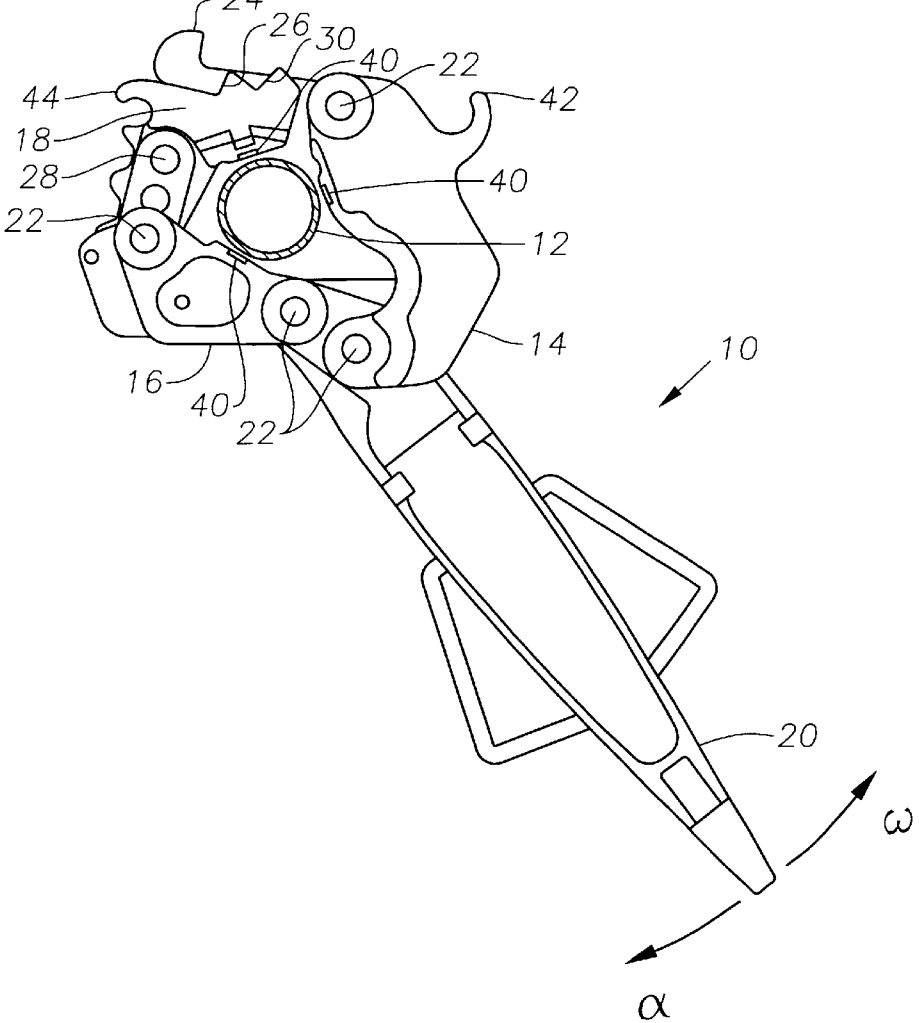
Fig. 1 (prior art)
FIG. 1 is a top view of a prior art manual tong apparatus.
Figure 3:
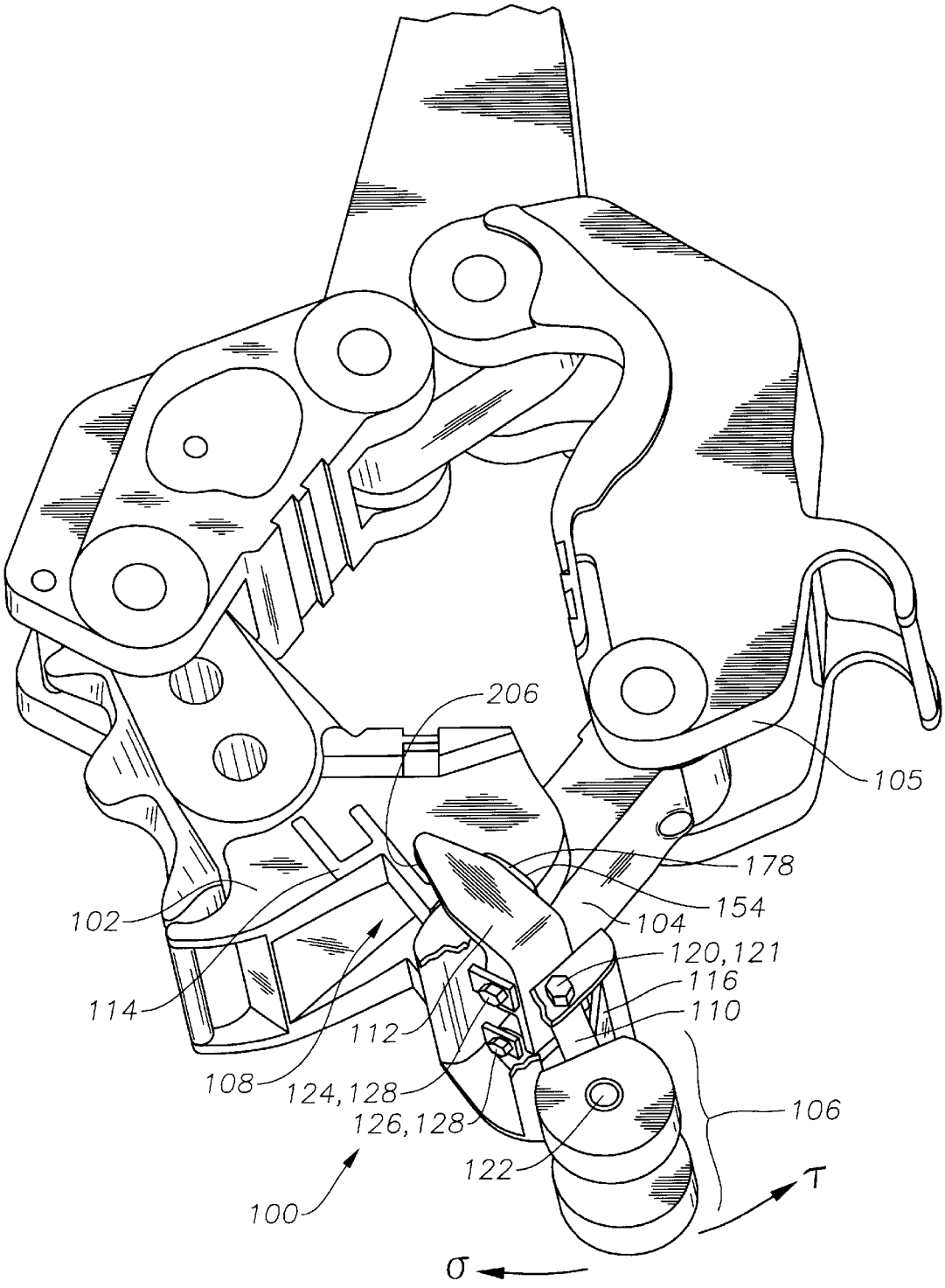
FIG. 3 is a perspective view of a latch assembly in the closed position in accordance with a preferred embodiment of the present invention.

Referring initially to FIG. 3, a close up of a preferred embodiment for a latch lock system 100 of a manual pipe tong apparatus is shown. Preferred latch lock system 100 includes a modified lug jaw 102, a latch arm 104 mounted to long jaw 105, a handle 106, and a secondary catch system 108. Secondary catch system 108 further includes a pivot member 110, two rocker arms 112, and a latch (catch) receiver 114 integral with lug jaw 102. Rocker arms 112 are attached to latch arm 104 by fasteners 128.

Pivot member 110 includes an engagement member 116, is secured to the end of latch arm 104 by fastener 120 and is free to rotate in directions $\sigma$ and $\tau$ about a handle axis 121. Handle 106 can be of any design or configuration available but is preferably a bolt on device that is removably secured at location 122 at the end of pivot member 110. Such a handle is described in U.S. patent application Ser. No. 09/505074 filed on Feb. 16, 2000 entitled Multi-Piece Manual Tong Safety Handle hereby incorporated herein by reference.

Fasteners 128 and 120 can be of any permanent, semi-permanent, or temporary type of fastener but are preferably generally cylindrical in form and include a longitudinal axis. Although fasteners 128 and 120 shown in FIG. 3 are shown as threaded bolts with corresponding nuts, screws, clevis pins, or press-fit rods may be used in their place without changing the function of the device presented herein. Torsion springs 130 (not visible in FIG. 3 but shown in FIG. 8) are mounted on fasteners 128 so as to bias rocker arms 112 toward lug jaw 102.

Figure 4:
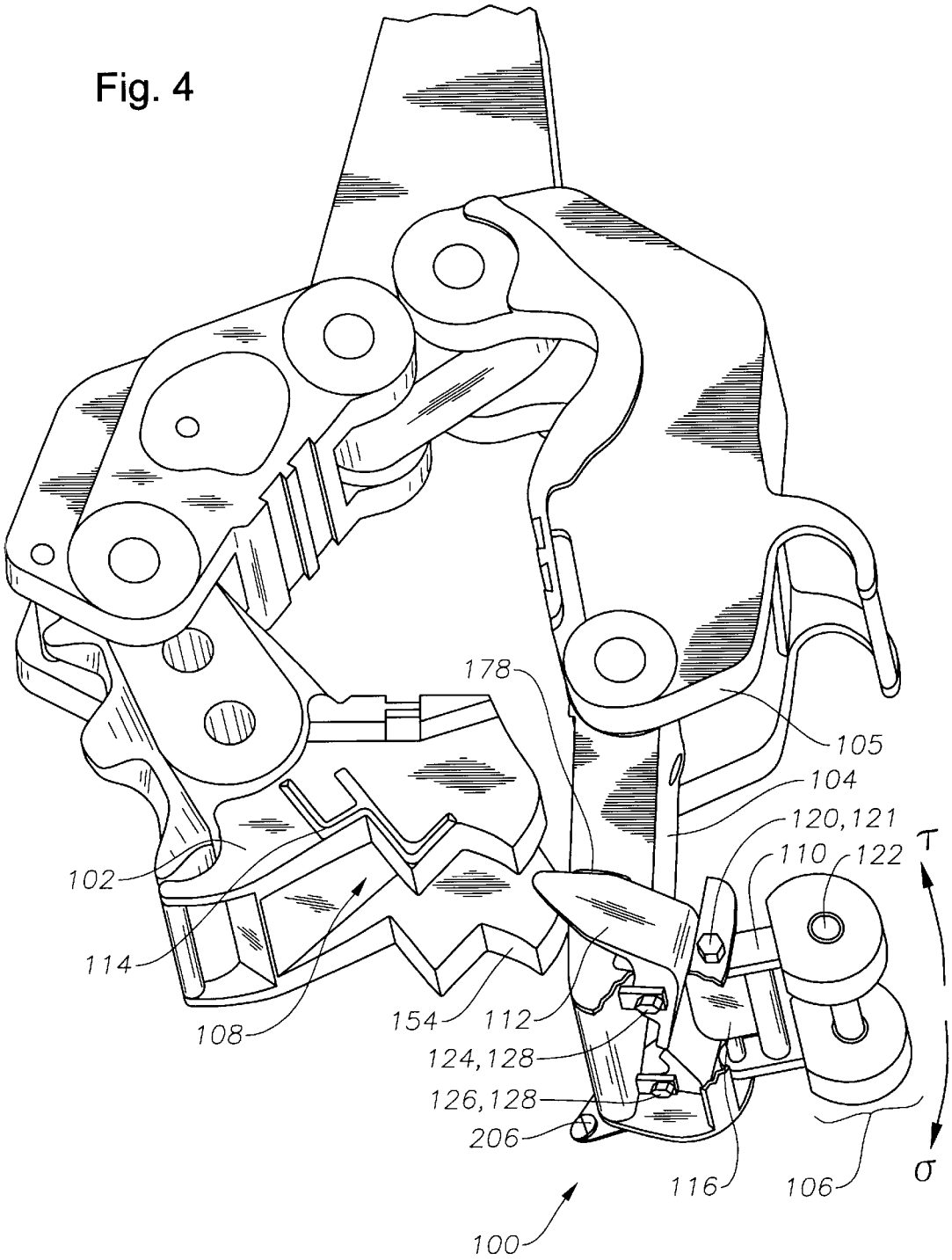
FIG. 4 is a perspective view of the latch assembly of FIG. 3 in the open position.
Figure 5:
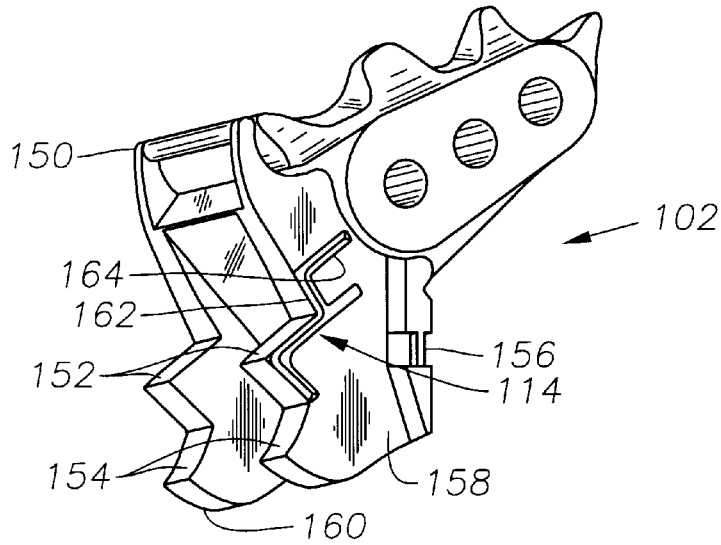
FIG. 5 is a perspective view of the lug jaw of FIG. 3.

Referring now to FIG. 5, a preferred embodiment of lug jaw 102 includes latch receiver 114, a handle 150, latch steps 152 and 154, and a location 156 to mount tong die teeth. Handle 150 is to assist in the manipulation of tong apparatus and is shown as a simple cast-in bar handle but can be of any configuration preferable to the tong operator or manufacturer. Latch receivers 114 are provided as integral bosses on each of the top and bottom faces 158,160 of lug jaw 102 in the latching region. Latch receivers 114 can either be cast or forged into place upon lug jaw 102 during manufacture or can be secured to lug jaw 102 using any standard attachment method following manufacture of lug jaw 102. Latch receiver 114 attachment methods can include but are not limited to welds, brazed joints, bolts, rivets, adhesives, or interference fits. Latch receivers 114 preferably have a tapered leading edge 162 and a trailing edge 164 that is generally perpendicular to the face (158 or 160) to which latch receiver 114 is mounted. Latch steps 152 and 154 are for receiving latch arm 104 as shown in FIGS. 3 and 4 in position on manual tong device and correspond to the various gauge sizes that lug jaw 102 is able to accommodate.

Figure 6:
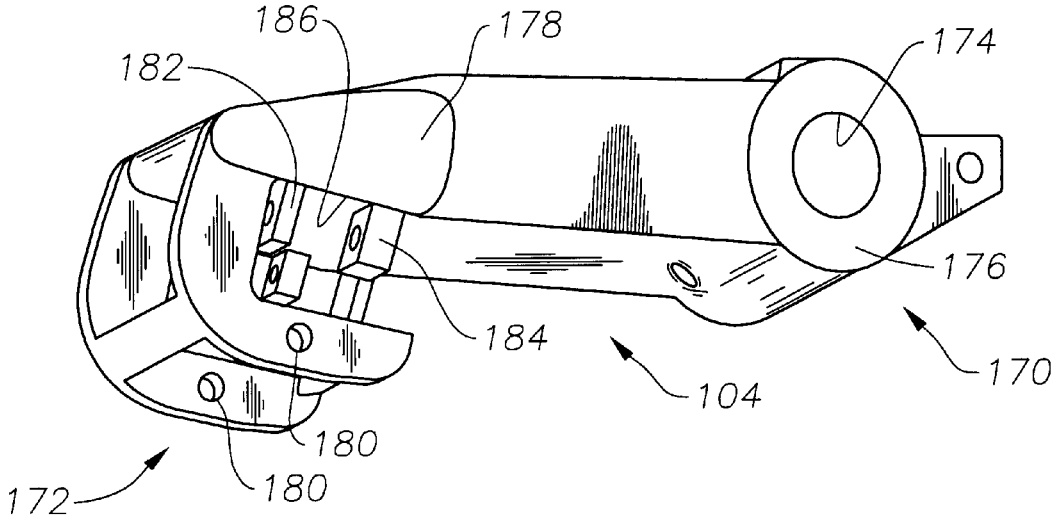
FIG. 6 is an enlarged view of the latch arm of FIG. 3.

Referring now to FIG. 6, latch arm 104 is shown in more detail. Latch arm 104 includes an attachment end 170 and a latch end 172. Attachment end 170 includes a bore 174 for attaching latch arm 104 to the end of long jaw 105 of FIG. 3. Each end of bore 174 forms an annular wear face 176. Latch end 172 includes an upset portion 178, bores 180, and rocker arm mounts 182 and 184 on surface 186. Upset portion 178 is fashioned so that it seats securely within the corresponding geometries of latch steps 152, 154 of lug jaw 102 (FIG. 5). Bores 180 allow the mounting of pivot member (110 of FIG. 3) to latch arm 104. Rocker arm mounts 182 and 184 are positioned in line with locations 124 and 126 of FIG. 3 to retain rocker arm device 112 and fasteners 128 in place. A gap exists between rocker arm mounts 182 and 184 to allow for torsion spring 130 of FIG. 8 to be easily positioned. One set of rocker arm mounts 182 and 184 is used for each rocker arm utilized in latch lock system 100.

Figure 7:
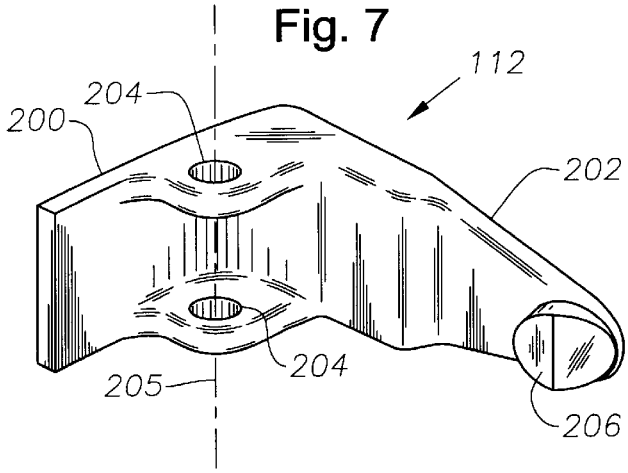
FIG. 7 is a perspective view of the up-down rocker arm of FIG. 3.

Referring now to FIG. 7, a preferred rocker arm 112, as used in secondary catch system 108 of FIG. 3, includes a back 200 and a top 202 positioned approximately 90° relative to each other. Mounting holes 204 are preferably positioned in a coaxial arrangement that defines an axis 205 that is generally parallel to the intersection between back 200 and top 202. Holes 204 are positioned and sized so that rocker arm 112 can be mounted upon mounts 182 and 184 by fasteners 128. Once mounted, rocker arm is allowed to pivot about axis defined by holes 204. At a remote end of top 202 is a catch 206 that generally corresponds to the profile of latch receivers 114.

Figure 8:
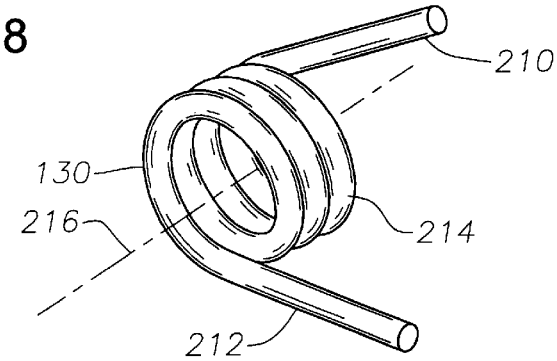
FIG. 8 is a perspective view of a torsion spring in accordance with a preferred embodiment of the present invention.

FIG. 8 details a perspective view of a preferred torsion wire spring 130 for use in latch lock mechanism 100. Torsion wire spring 130 includes tines 210 and 212, and a coil 214 that defines a center axis 216. Squeezing tines 210 and 212 together, activates coil 214 and results in spring forces that urge tines 210 and 212 apart. Torsion springs 130 are preferably mounted on fasteners 128 of FIG. 3 to bias rocker arms 112 toward lug jaw 102. An additional torsion spring (not shown) may also be mounted upon the axis of fastener 120 in order to bias handle 106 and pivot member 110 in direction $\sigma$ but is not required. Torsion springs 130 and 132 may be manufactured from identical components in order to keep production costs at a minimum.

Referring to FIGS. 3 and 6–8, the installation of the two rocker arms upon latch arm 104 can be described. Torsion wire springs 130 are placed in between rocker arm mounts 182 and 184 of and held tightly in place while fasteners 128 are passed through holes 204, mounts 182 and 184, and coils 216. For each spring 130 installed, one tine engages back 200 of rocker arm 112 while the other tine 212 engages surface 186 adjacent to upset portion 178 of latch arm 104 FIG. 6. Once installed, rocker arms 112 are allowed to pivot around fasteners 128 in an up-down fashion, with torsion spring 130 biasing top 202 of each rocker arm toward upset portion 178 of latch arm 104. Following installation of rocker arms 112, pivot member 110 and handle 106 can then be added to latch arm at location 180 by fastener 120. Once handle and pivot member are installed, latch lock system 100 is operable.

Latch lock system 100 of FIG. 3 is engaged by swinging long jaw 105 and latch arm 104 into position with lug jaw 102 of FIG. 5 so upset portion 178 of latch arm engages latch step 152 or 154. With typical prior art latches, this mechanism is all that holds lug jaw 102 and long jaw 105 together, making the connection dependant on tension between jaws 102 and 105 to maintain latch arm 104 within latch step 152 or 154.

When this connection is made with the latch lock system 100 of the present invention, the tapered profiles 162 of latch receivers 114 deflect catch points 206 of rocker arms 112 away from lug jaw 102, allowing them to slide over latch receiver 114. Once catch point 206 of each rocker arm has cleared latch receiver 112, torsion spring 130 forces rocker back against lug jaw 102, allowing the profile of catch point 206 to engage perpendicular edge 164 of receiver 114. This action provides a secondary connection to prevent separation of jaws 102 and 105 if tension is lost between them or if tong apparatus is rotated backwards.

Referring now to FIG. 4, the disengagement of latch lock system 100 can be described. When desired, latch lock system 100 may be disengaged by first deactivating secondary catch system 108, then removing latch arm, 104 from lug jaw 102. To deactivate secondary catch system 108, pivot member 110 with attached handle 106 is rotated about axis 121 in the $\tau$ direction. Rotating pivot member 110 enables engagement member 116 to strike the back faces 200 of rocker arms 112 causing them to oppose torsion springs 130 and pivot about fasteners 128. In the pivoted position, catch tips 206 of rocker arms 112 are cleared from latch receivers 114 upon lug jaw 102, thus enabling latch arm 104 to be swung free from lug jaw 102. Once handle 106 and pivot member 110 have been swung in direction $\tau$, latch lock system 100 is able to function in a manner similar to a conventional manual tong latch.

Figure 9:
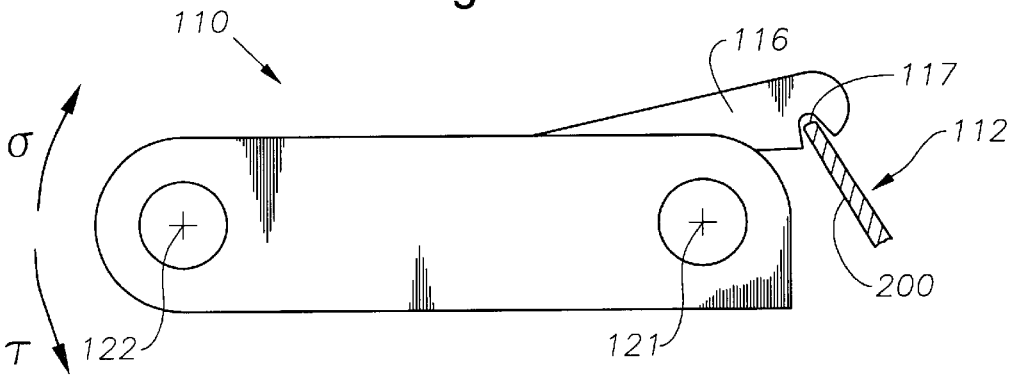
FIG. 9 is a top view drawing of a While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Referring now to FIG. 9, a top view of the engagement member 116 of pivot member 110 is shown. Engagement member 116 shown includes a cutout notch 117 to grasp back 200 of rocker arm 112 when latch lock system is engaged. Notch 117 acts as a hook to retain the rear of rocker arms 112 in the event of a component failure and acts as an additional safety measure. With notch 117 securely around rocker arms 112, latch lock system 110 cannot be opened unless pivot member 110 is rotated in direction $\tau$ (as shown in FIGS. 3–4). As mentioned above, a torsion spring (not shown) may be employed about fastener (120 of FIGS. 3–4) at location 121 to bias pivot member 110 in direction $\sigma$ to prevent premature release in the event of a failure. To disengage latch lock system 100, pivot member 110 is rotated in direction $\tau$ and rocker arms 112 are released by notch 117 and engaged by the remainder of member 116. With rocker arms 112 engaged, secondary catch 108 is deactivated, allowing latch lock system 100 to be opened.

Latch lock system 100 is desirable over designs of the prior art because it provides added measures of safety and convenience to the operators of manual pipe tongs in rig environments. For sake of convenience, the latch lock device maintains the jaws of manual tong apparatus closed when a state of tension does not exist within the latch arm. Without latch lock mechanism 100, jaws of manual tong could open if the load applied to tong were slackened or if tong were rotated counter to the gripping direction, in a matter similar to a ratchet. The operator of a manual tong apparatus incorporating latch lock assembly 100 is granted and additional level of safety in the event of a failure of a manual tong component. Without safety latch lock, the latch arm of a manual tong apparatus can release from the lug jaw rapidly and strike a nearby rig operator.

What is claimed:

1. For a manual tong device to grip a tubular member that is determined to be closed when a latch arm attached to a short jaw engages a lug jaw, whereby tension within said latch arm maintains tong closure, a latch lock mechanism for securing said latch arm within a latching step of said lug jaw comprising;

one or more rocker arms pivotably mounted upon said latch arm so as to pivot about an axis that is normal to the tubular member;

said rocker arms including a catch tip at an end that extends away from said latch arm and contacts said lug jaw when said latch lock mechanism is enacted;

one or more receiver devices with profiles corresponding to said catch tips of said rocker arms;

said receiver devices positioned adjacent to said latching step of said lug jaw to receive said catch tips when said manual tong is closed;

a spring device to bias said rocker arms such that said catch tips seek contact with said lug jaw adjacent to said latch step;

a handle rotatably mounted upon said latch arm such that said handle has a rotation axis generally parallel with the tubular member;

said handle including an engagement device to strike said rocker arm and oppose the bias of said spring device to allow for opening of said tong device when said handle is rotated in a corresponding direction.

2. The latch lock mechanism of claim 1 wherein the latch lock mechanism comprises a single rocker arm pivotably mounted upon said latch arm.

3. The latch lock mechanism of claim 2 wherein said rocker arm is mounted to said latch arm with said rocker arm engaging a top or bottom surface of said lug jaw.

4. The latch lock mechanism of claim 3 wherein said receiver device is positioned upon said top or bottom surface of said lug jaw.

5. The latch lock mechanism of claim 2 wherein said lug jaw includes more than one latching step to accommodate a range of sizes of said tubular member.

6. The latch lock mechanism of claim 5 wherein said receiver device is configured to allow said catch tip of said rocker arm to engage the lug jaw in more than one configuration.

7. The latch lock mechanism of claim 1 wherein the latch lock mechanism comprises at least two rocker arms pivotably mounted upon said latch arm.

8. The latch lock mechanism of claim 7 wherein said rocker arms are mounted to said latch arm with at least one of said rocker arms engaging a top surface of said lug jaw and at least one of said rocker arms engaging a bottom surface of said lug jaw.

9. The latch lock mechanism of claim 8 wherein said receiver devices are positioned upon said top and bottom surfaces of said lug jaw.

10. The latch lock mechanism of claim 7 wherein said lug jaw includes more than one latching step to accommodate a range of sizes of said tubular member.

11. The latch lock mechanism of claim 10 wherein said receiver devices are configured to allow said catch tips of said rocker arms to engage the lug jaw in more than one configuration.

12. A manual tong for gripping a tubular member and applying a torsional force thereto, comprising:

a lug jaw;

an arm pivotally mounted on said lug jaw, said arm and said lug jaw defining a tool plane that is normal to the tubular member;

a first latching mechanism engaging said arm and said lug jaw, said first latching mechanism being tightened in latching engagement by the application of the torsional force; and a second latching mechanism maintaining engagement between said arm and said lug jaw, said second latching mechanism comprising;

two catch members mounted on said latch arm, one oriented to engage a top face of said lug jaw and another to engage a bottom face of said lug jaw;

receiver ridges mounted on each of said top and said bottom faces of said lug jaw to receive and retain said catch members; and at least one spring device to bias said catch members toward said top and bottom faces of said lug jaw.

13. The latch lock system of claim 12 wherein said catch members are released from engagement with said receiver ridges by manipulating a handle to displace said catch members away from said top and bottom faces of said lug jaw.

14. A manual tong for gripping a tubular member and applying a torsional force thereto, comprising:

a lug jaw;

an arm, said arm and said lug jaw defining a tool plane that is normal to the tubular member, said arm and said lug jaw including a first latching mechanism engaging said arm and said lug jaw, said first latching mechanism being tightened in latching engagement by the application of the torsional force;

a second latching mechanism maintaining engagement between said arm and said lug jaw, said second latching mechanism comprising at least one normally closed, spring-loaded catch member operable in a plane normal to the tool plane.

15. The manual tong of claim 12 wherein said second latching mechanism comprises at least two spring-loaded catch members.

16. The manual tong of claim 15 wherein said lug jaw includes a top face and a bottom face and a receiver device mounted on the top or bottom face of said lug jaw to engage the catch member.

17. The manual tong of claim 16 wherein said catch member includes a profiled catch tip at a location where contact is made with said lug jaw.

18. The manual tong of claim 17 wherein said receiver device corresponds with said profiled catch tip to secure said second latching mechanism.

19. The manual tong of claim 16 wherein said receiver device is in the form of a ridge that extends along said top or bottom face of said lug jaw.

20. The manual tong of claim 16 wherein said catch member is biased with a spring device to maintain contact with said top or bottom face until the catch member's release is desired.

21. The manual tong of claim 20 wherein engagement of said catch member with said receiver device is deactivated by moving a manipulation handle in a first direction that displaces said catch member away from said top or bottom face of said lug jaw.

22. The manual tong of claim 21 wherein said manipulation handle is configured to retain said catch member in position when said manipulation handle is not moved in said fist direction.

23. The manual tong of claim 20 wherein said spring device is a torsion wire coil spring.

24. The manual tong of claim 20 wherein said spring device comprises an elastomer.

25. The manual tong of claim 16 wherein said lug jaw includes more than one latching step to accommodate a range of sizes of said tubular member.

26. The manual tong of claim 25 wherein said receiver device is configured to allow said catch tip of said catch member to engage said lug jaw in more than one configuration.

27. The manual tong of claim 12 wherein said second latching mechanism comprises at least two spring-loaded catch members.

28. The manual tong of claim 27 wherein said lug jaw includes a top face and a bottom face and a plurality of receiver devices mounted on each of said top and bottom faces of said lug jaw.

29. The manual tong of claim 28 wherein said catch members include profiled catch tips at locations where contact is made with said lug jaw.

30. The manual tong of claim 29 wherein said receiver devices correspond with said profiled catch tips to secure said second latching mechanism.

31. The manual tong of claim 28 wherein said receiver devices are in the form of ridges that extend along said top and bottom faces of said lug jaw.

32. The manual tong of claim 28 wherein said catch members are biased with at least one spring device to maintain contact with said top and bottom faces until the catch members' release is desired.

33. The manual tong of claim 32 wherein engagement of said catch members with said receiver devices is deactivated by moving a manipulation handle in a first direction that displaces said catch members away from said top and bottom faces of said lug jaw.

34. The manual tong of claim 33 wherein said manipulation handle is configured to retain said catch members in position when said manipulation handle is not moved in said first direction.

35. The manual tong of claim 32 wherein said spring devices are torsion wire coil springs.

36. The manual tong of claim 32 wherein said spring devices comprise elastomers.

37. The manual tong of claim 28 wherein said lug jaw includes more than one latching step to accommodate a range of sizes of said tubular member.

38. The manual tong of claim 37 wherein said receiver devices are configured to allow said catch tips of said catch members to engage said lug jaw in more than one configuration.

* * * * *